US007664409B2

(12) United States Patent
Nishida et al.

(10) Patent No.: US 7,664,409 B2
(45) Date of Patent: Feb. 16, 2010

(54) IMAGE FORMING DEVICE

(75) Inventors: Akinori Nishida, Kyoto (JP); Takahiro Sasai, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 378 days.

(21) Appl. No.: 11/857,893

(22) Filed: Sep. 19, 2007

(65) Prior Publication Data

US 2008/0181631 A1 Jul. 31, 2008

(30) Foreign Application Priority Data

Nov. 6, 2006 (JP) ..... 2006-300959

(51) Int. Cl.
*G03G 15/08* (2006.01)

(52) U.S. Cl. ..... 399/30; 399/61

(58) Field of Classification Search ..... 399/9, 399/24, 25, 27–30, 53, 58, 61, 67, 70
See application file for complete search history.

(56) References Cited

U.S. PATENT DOCUMENTS 4,897,696 A * 1/1990 Matsumoto ..... 399/33

FOREIGN PATENT DOCUMENTS

| | | | |
|---|---|---|---|
| JP | 2-61657 | * | 3/1990 |
| JP | 8-95422 | A | 4/1996 |
| JP | 10-307434 | | 11/1998 |
| JP | 2003-162141 | | 6/2003 |
| JP | 2005-16624 | A | 1/2005 |
| JP | 2005-17459 | A | 1/2005 |
| JP | 2007-25413 | * | 2/2007 |

OTHER PUBLICATIONS

Official communication issued in counterpart Japanese Application No. 2006-300959, mailed on Sep. 30, 2008.

* cited by examiner

*Primary Examiner*—Hoan H Tran
(74) *Attorney, Agent, or Firm*—Keating & Bennett, LLP

(57) ABSTRACT

A control device executes toner concentration control that controls an operation of a developing device such that a value of detection output detected by a concentration detecting device falls within a predetermined range. Moreover, when controlling drive of a first driving device, which drives at least an image carrier, and drive of a second driving device, which drives at least a fuser device, the control device executes operation control that starts the drive of the first driving device before the drive of the second driving device.

12 Claims, 7 Drawing Sheets

IMAGE FORMING DEVICE

CROSS-REFERENCE TO RELATED APPLICATIONS

This application claims priority under 35 U.S.C. 119 to Japanese Patent Application No. 2006-300959, filed on Nov. 6, 2006, which application is hereby incorporated by reference in its entirety.

BACKGROUND OF THE INVENTION

1. Field of the Invention

The present invention relates to an image forming device that is preferably used in a copier, a printer, and a facsimile machine etc. In particular, the present invention relates to an image forming device that forms images by using two-component developer including toner and carrier.

2. Description of the Related Art

An image forming device that forms images by the following image forming processes is known as an electrophotographic image forming device using a photoconductive drum, for example, as an image carrier. A surface of the photoconductive drum is charged and exposed to form an electrostatic latent image. Toner is adhered to the electrostatic latent image, and the image is visualized as a toner image. Then, the toner image is transferred to a paper, and the transferred toner image is fixed to the paper.

Two types of developer, two-component developer and one-component developer, have been conventionally used as the developer that is used to form an image. The two-component developer includes toner and carrier, which is composed of magnetic particles. The one-component developer includes only the toner. When using the two-component developer, the toner and the carrier are rubbed against each other, and the toner can be charged in good condition. Therefore, high-resolution image forming can be stably performed. In an image forming device using such two-component developer, it is required to maintain a steady mixture ratio of the toner and the carrier in the developer. Therefore, toner concentration is constantly detected, and toner supply is controlled in order that the toner concentration is kept within a predetermined range. A toner-concentration detecting process has been conventionally performed as follows. A conventional image forming device includes a main drive motor, a development driving mechanism, which supplies a developer flowing mechanism with power after the main drive motor, and a control device. In accordance with history data based on an operation history of electrophotographic processes, the control device controls timing that indicates a time interval between a start time of an operation of the development driving mechanism and a time of reading a toner concentration signal. And then, the control device reads the toner concentration signal.

Immediately after a transporting operation of the two-component developer is started after the transporting operation has been stopped, an amount and density of the developer are not stable. Accordingly, since an output signal from a toner-concentration detecting sensor greatly changes, toner concentration cannot be detected accurately. Under such a state, when the toner supply is controlled based on the detection signal, an appropriate amount of toner is not supplied. Therefore, in the conventional image forming device, the developer transporting operation is not performed until detection output of the toner concentration becomes stable.

Accordingly, upon a preparation operation performed when a power supply of the image forming device is turned on, or upon an image forming operation for the first paper performed when the image forming processes are started, the following control is performed. That is, the control device starts driving the photoconductive drum etc. along with the developer transporting operation at timing when a fixing temperature reaches a predetermined temperature. However, in the conventional image forming device, a problem is that, since it takes time until the detection output of the toner concentration becomes stable, the subsequent processes will be delayed.

SUMMARY OF THE INVENTION

According to preferred embodiments of the present invention, in an image forming device that performs operation control based on a fixing temperature, delay accompanying a toner-concentration detecting process will not occur.

According to a preferred embodiment of the present invention, the image forming device includes an image carrier, a charging device, an exposure device, a developing device, a transfer device, a fuser device, a control device, a first driving device, a second driving device, and a concentration detecting device. The charging device charges a surface of the image carrier. The exposure device exposes the charged surface of the image carrier to form an electrostatic latent image. The developing device stores two-component developer and visualizes the electrostatic latent image formed on the surface of the image carrier by using the two-component developer. The transfer device transfers a toner image that is formed on the image carrier to a paper. The fuser device fixes the transferred toner image to the paper. The control device rotationally controls the fuser device and the image carrier, and also controls each of the above-described devices to form an image on the paper. The first driving device drives the devices other than the fuser device. The second driving device drives the fuser device separately from the other devices. The concentration detecting device detects toner concentration of the two-component developer that is transported in the developing device. The control device includes a supply control device and an operation control device. The supply control device controls the developing device in order that a value of detection output detected by the concentration detecting device falls within a predetermined range. When controlling the drive of the first driving device and the second driving device, the operation control device starts driving the first driving device before the second driving device, and controls the supply control device.

Moreover, the operation control device starts driving the second driving device when a fixing temperature of the fuser device exceeds a predetermined temperature.

According to the preferred embodiment of the present invention, the image forming device includes the first driving device, which drives the devices other than the fuser device, and the second driving device, which drives the fuser device separately from the other devices. Further, in the image forming device, when controlling the drive of the first driving device and the second driving device, the drive of the first driving device is started before the drive of the second driving device to control the supply control device. Therefore, without relating to the fixing temperature of the fuser device, the toner concentration control can be started in advance. Accordingly, compared with the conventional image forming device, the concentration control is performed at earlier timing, and it becomes possible to take time for stabilizing the toner-concentration detection output before the fixing temperature reaches the predetermined temperature. Moreover, in the image forming device that performs the operation control based on the fixing temperature, delay accompanying the toner-concentration detecting process will not occur in subsequent processes.

Since the drive of the second driving device is started when the fixing temperature of the fuser device exceeds the predetermined temperature, the operation control based on the fixing temperature is performed similarly to the conventional operation control, and thus, the image forming processes can be stably performed.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
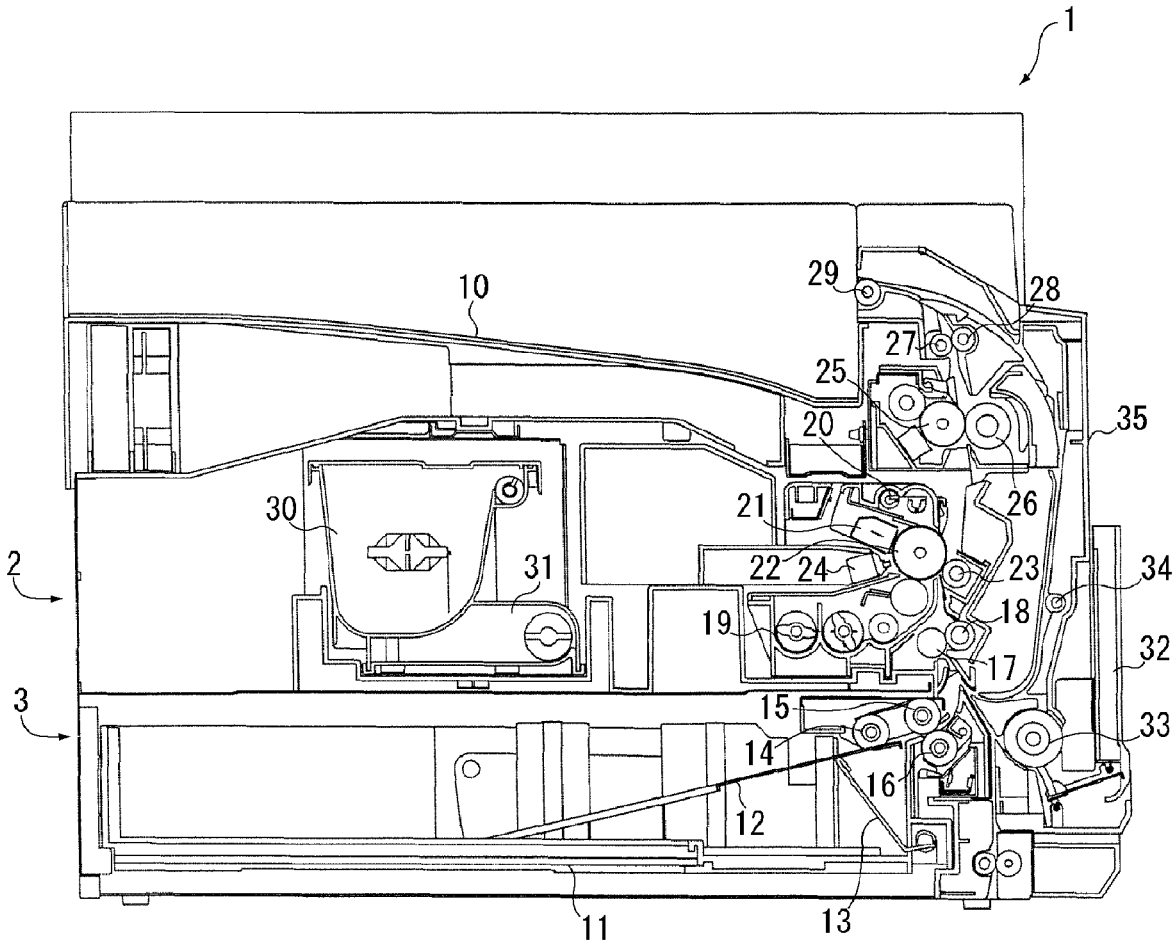
FIG. 1 is a schematic cross-sectional view of an entire image forming device according to a preferred embodiment of the present invention.

FIG. 1 is a schematic cross-sectional view illustrating an entire image forming device according to a preferred embodiment of the present invention. A paper discharge tray 10 is arranged on an upper portion of an image forming device 1. A recording unit 2 and a paper feed unit 3 are arranged on a lower portion of the image forming device 1.

A paper feed cassette 11 is arranged in the paper feed unit 3. A plurality of papers of a predetermined size can be stacked on a flapper 12 that is arranged in the paper feed cassette 11. An arm 13 is rotated by a motor and fluctuated upward, and accompanying the fluctuating movement thereof, the flapper 12 is fluctuated upward. A pick up roller 14 is arranged on a right end portion of the paper feed cassette 11. The flapper 12 is supported by the arm 13 such that an upper surface of the stacked papers is pressed against the pick up roller 14. Under such a state, when the pick up roller 14 is rotationally driven, the papers are fed to a paper transporting path one sheet at a time by frictional force. Then, the fed paper is nipped between a feed roller 15 and a pressing roller 16 and transported.

Further, the paper is transported to the recording unit 2 by a resist roller 17 and a pressing roller 18. In order to record on the transported papers, the recording unit 2 includes a developing unit (a developing device) 19, a cleaning mechanism (a cleaning device) 20, a corona charger (a charging device) 21, a photoconductive drum (an image carrier) 22, a transfer roller (a transfer device) 23, an exposure head (an exposure device) 24, and a fuser roller (a fuser device) 25.

The developing unit 19 stores two-component developer (hereinafter referred to as "the developer"). The developing unit 19 includes a pair of augers 41 and 42, each having a spiral blade. The pair of augers 41 and 42 transport the developer such that the developer is circulated in a predetermined direction. The circulated and transported developer is supplied to a developing roller 40 via a paddle. The developing roller 40 is composed of a magnetic roller arranged therein and a cylindrical developing sleeve arranged on an outer circumferential surface of the magnetic roller. Carrier in the developer is adhered to a surface of the developing sleeve by magnetic force of the magnetic roller, and thus, a carrier nap is formed. Toner is adhered to the formed carrier nap. When using the two-component developer, the carrier and the toner are charged in mutually opposite polarities by friction generated while the carrier and the toner are circulated and transported. Accordingly, the toner can be stably maintained on the carrier nap by electrical adsorptivity.

A concentration detecting sensor 44 is attached in the vicinity of a developer transporting path in which the developer is transported by the augers 41 and 42. The concentration detecting sensor 44 detects toner concentration of the developer transported through the developer transporting path. Toner supply control is performed based on an output signal from the concentration detecting sensor 44. A publicly-known sensor that detects the toner concentration by measuring permeability of the developer can be used as the concentration detecting sensor 44. A permeability sensor includes the following characteristic features. As the toner concentration decreases, density of the carrier, which is a magnetic body, increases accordingly. Therefore, the permeability increases, and consequently, output from the sensor rises. Conversely, as the toner concentration increases, the carrier density decreases accordingly, and consequently, the output from the sensor falls. The toner is supplied from a toner cartridge 30 to the developing unit 19 via a supplying mechanism 50.

The cleaning mechanism 20 includes a cleaning blade. The cleaning blade scrapes off foreign materials such as the residual toner and paper scraps adhered to a surface of the photoconductive drum 22 after transfer to clean the surface of the photoconductive drum 22. The foreign materials such as the residual toner collected by the cleaning mechanism 20 are transported to a waste toner storing unit 31 and discharged.

The corona charger 21 uniformly charges the surface of the photoconductive drum 22 by corona discharge from a discharge wire. The exposure head 24 exposes on the uniformly charged photoconductive drum 22 based on an image recording signal, and thus, an electrostatic latent image is formed. Since the developing sleeve in the developing unit 19 is rotated, when the carrier nap formed on the surface of the developing sleeve comes close to the surface of the photoconductive drum 22, the toner adhered to the carrier nap is transferred to the electrostatic latent image, and the electrostatic latent image is visualized as a toner image. The transfer roller 23 is positioned opposite the photoconductive drum 22 nipping the paper therebetween. When a predetermined voltage is applied to the transfer roller 23, the toner image formed on the surface of the photoconductive drum 22 is transferred to the paper. Thus, a series of processes required to form the image is performed. The toner image transferred to the paper is nipped between the fuser roller 25 and a pressing roller 26, heated, and pressed to be fixed to the paper. The paper with the toner image fixed thereto is transported to a discharging path by a feed roller 27 and a pressing roller 28, and discharged onto the paper discharge tray 10 by a discharge roller 29.

A manual paper-feeding mechanism and a reverse transportation mechanism are provided on a side surface of a device main body. When feeding the papers manually, a manual paper-feed tray 32 is opened, and the paper is inserted to a paper feed roller 33. The inserted paper is transported to the resist roller 17 and the pressing roller 18 by the paper feed roller 33, and a recording operation is performed on the transported recording paper. When performing reverse transportation, the paper, with one side recorded, is discharged by the discharge roller 29 once, and then, transported to a reverse transportation path by the reversely rotating discharge roller 29. After the paper is transported downward by a transportation roller 34, the paper is transported upward along the transportation path. The recorded paper is again transported by the resist roller 17 and the pressing roller 18, and the recording operation is performed on another side of the paper. Thus, both sides of the paper are recorded.

Figure 2:
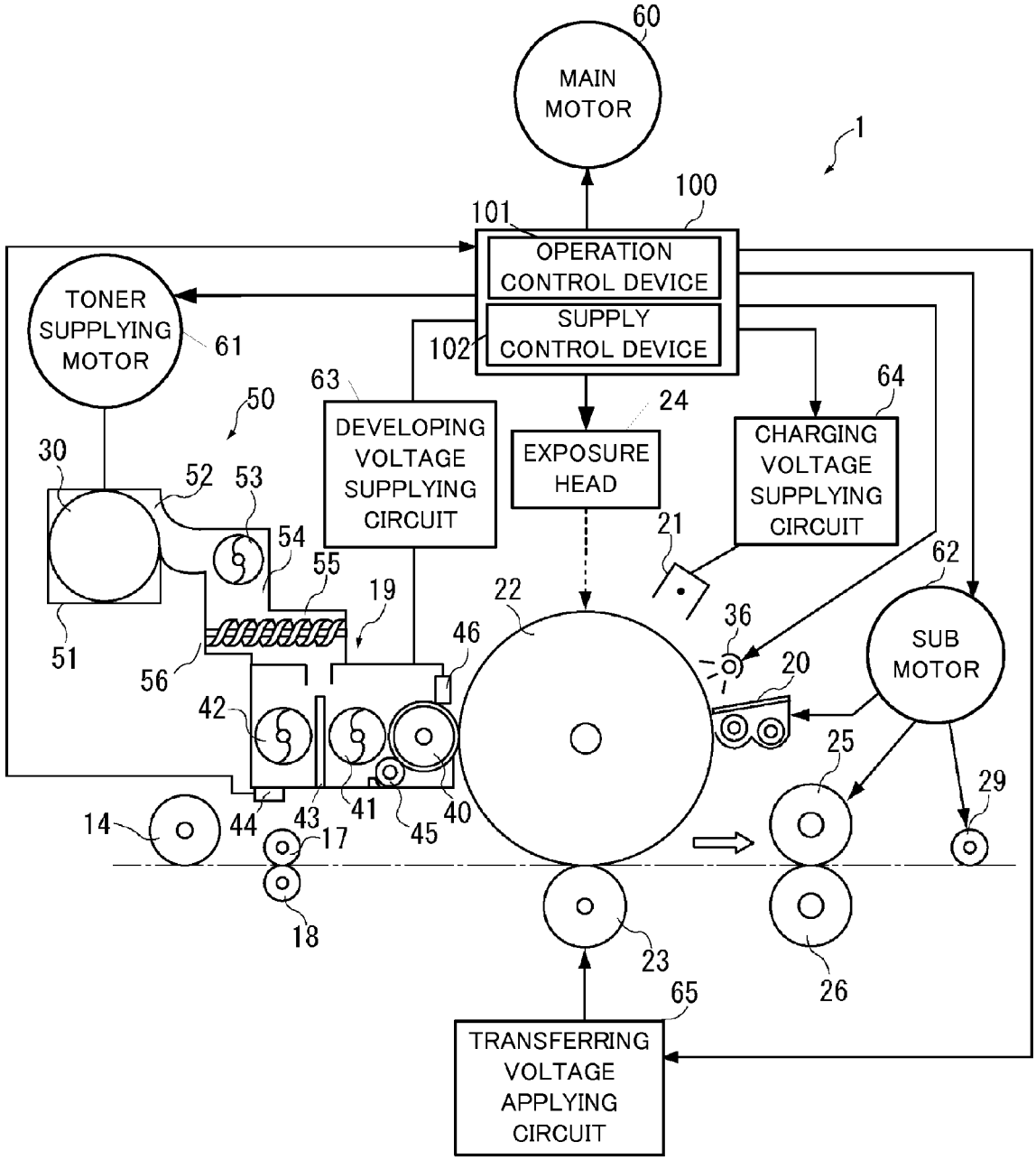
FIG. 2 is a schematic block configuration diagram according to a preferred embodiment of the present invention.

FIG. 2 is a schematic block configuration diagram of the image forming device illustrated in FIG. 1. The corona charger 21, the exposure head 24, the developing unit 19, the transfer roller 23, the cleaning mechanism 20, and an electricity removing lamp 36 are arranged around the photoconductive drum 22. While the photoconductive drum 22 is rotated, a series of discharging process, exposing process, developing process and transferring process is performed on the surface of the photoconductive drum 22. Then, a cleaning process and a residual-charge removing process are performed on the surface of the photoconductive drum.

In the developing unit 19, the developing roller 40 is arranged opposite the photoconductive drum 22. A developer storage portion is arranged on a side opposite the photoconductive drum 22 across the developing roller 40. The pair of augers 41 and 42 are arranged in the storage portion. Each rotating shaft of the augers 41 and 42 linearly extends in a perpendicular direction in the drawing. A bulkhead 43 is arranged between the augers 41 and 42. Since the augers 41 and 42 transport the developer in mutually opposite directions, the developer is circulated and transported around the bulkhead 43 inside the storage portion.

The concentration detecting sensor 44 is provided on a bottom surface of the developing unit 19, the bottom surface arranged on a side opposite the storage portion. The concentration detecting sensor 44 detects the toner concentration of the circulated and transported developer. The circulated and transported developer is supplied to the developing roller 40 by a supply paddle 45. The developer supplied to the surface of the developing sleeve of the developing roller 40 is equalized into an even layer by a blade 46.

The toner supplying mechanism 50 includes the toner cartridge 30. The toner cartridge 30 is exchangeably inserted into a cartridge supporting body 51. The toner from the toner cartridge 30 is transported to a hopper 54 via a toner send-out path 52. The hopper 54 includes transportation spirals 53 and 56. The toner from the hopper 54 is supplied to the storage portion of the developing unit 19 via a toner transporting path 55. The toner is supplied to the storage portion of the developing unit 19 via the toner transporting path 55 which includes the transportation spirals 53 and 56. A toner supplying motor 61 rotates the toner cartridge 30 to discharge the toner from the hopper 54. The toner supplying motor 61 rotates the transportation spirals 53 and 56 to perform a toner transporting operation.

The photoconductive drum 22 and each of the rollers are rotated by rotational power transmitted from a main motor 60 via a drive transmission mechanism such as a clutch mechanism (not illustrated), and the rotation thereof is controlled by a control device 100. In addition, the rotational power from the main motor 60 is also transmitted to the augers 41 and 42 etc. to perform a developer transporting operation of the augers 41 and 42 etc. of the developing unit 19. Moreover, rotational power from the toner supplying motor 61 is transmitted to perform a rotational operation of components arranged inside the toner cartridge 30 of the toner supplying mechanism 50 and a toner supplying operation by the transportation spirals 53 and 56 etc. Each of the operations is controlled by the control device 100.

The cleaning mechanism 20, the fuser roller 25, and the discharge roller 29 are rotated by rotational power transmitted from a sub motor 62 via a drive transmission mechanism such as a clutch mechanism (not illustrated), and the rotation thereof is controlled by the control device 100. In other words, the fuser roller 25 is rotated by the sub motor 62 separately from the other components such as the photoconductive drum 22 rotated by the main motor 60.

Control of voltages to be applied to the corona charger 21, the developing roller 40, and the transfer roller 23 is performed by respectively controlling a developing voltage applying circuit 63, a charging voltage applying circuit 64, and a transferring voltage applying circuit 65 by the control device 100.

The control device 100 includes an operation control device 101 and a supply control device 102. The operation control device 101 controls a series of operations for performing the processes required to form the image, a preparation operation such as a warm-up operation, and an operation for shifting to a standby state.

Based on a detection signal from the concentration detecting sensor 44, the supply control device 102 performs the toner supply control for the toner supplying mechanism 50, developer transportation control in the developing unit 19, and toner concentration control in the developing unit 19. Moreover, if an output value from the concentration detecting sensor 44 departs from a predetermined range, the supply control for the toner supplying mechanism 50 and the transportation control in the developing unit 19 are performed, and then, the toner concentration control is performed in order that the output value from the concentration detecting sensor 44 falls within the predetermined range.

Figure 3:
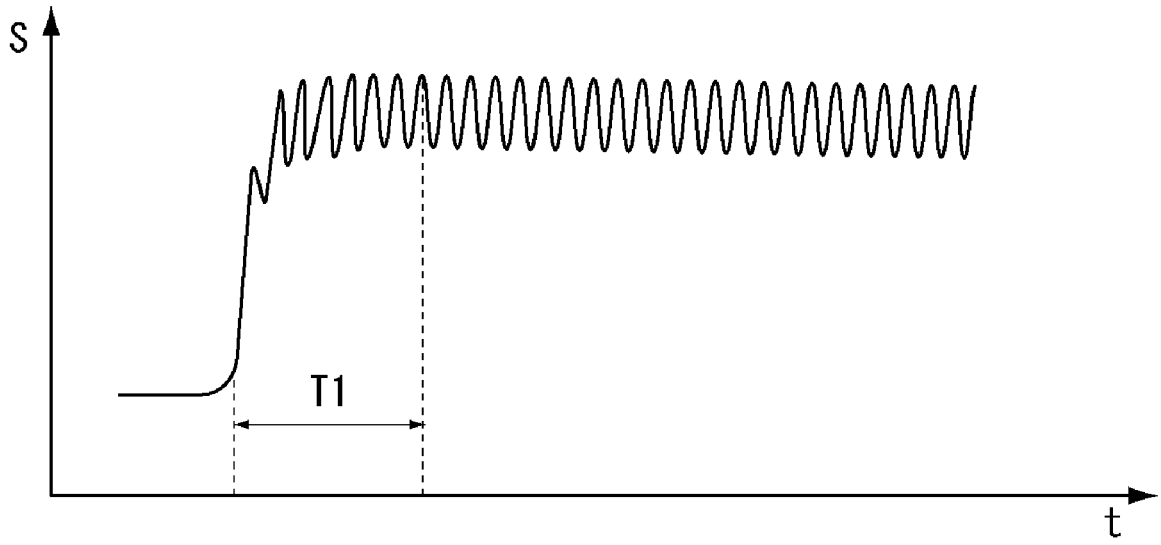
FIG. 3 is a graph illustrating output of a detection signal from a concentration detecting sensor.

FIG. 3 is a graph illustrating an example of output of the detection signal from the concentration detecting sensor 44 when the developer transporting operation is started after a long period of resting state of the developing unit 19. In the graph in FIG. 3, a horizontal axis represents a time passage, and a vertical axis represents the output of the detection signal. It can be understood from the graph that the output is unstable immediately after the device starts driving (for a time period defined by time "T1" in the graph), and then, the output becomes stable afterwards. This unstable state of the output occurs due to such factors in which the developer circulation and transportation are not stably performed immediately after the drive of the developing unit 19 is started. Due to the above-described characteristics of the detection output from the concentration detecting sensor 44, it is required to perform the toner circulating and transporting operation for a predetermined time period until an output state becomes stable.

In FIG. 3, even in a state in which the output is stable, predetermined-periodic amplitude fluctuation can be seen. The amplitude fluctuation occurs because, when the auger 42 axially rotates, a blade portion of the auger 42 periodically comes close to the concentration detecting sensor 44. The detection signal is sampled in each sampling period which is synchronized with a rotational period of the auger 42, and an average value is calculated from history data of the sampling performed predetermined times. Accordingly, thus calculated average value is preferably used as the detection output from the concentration detecting sensor 44.

The operation control device 101 performs the operation control in order to start the warm-up operation and an image forming operation on condition that a fixing temperature reaches a predetermined temperature. Then, when starting the drive of the main motor 60, the toner supplying motor 61, and the sub motor 62, the operation control device 101 starts the drive of the main motor 60 and the toner supplying motor 61 in advance of the drive of the sub motor 62. Therefore, the toner concentration is controlled before the drive of the fuser roller 25 is started. Since the toner concentration is controlled in advance, drive-start timing of the sub motor 62 can be adjusted to synchronize the time at which the detection output from the concentration detecting sensor 44 becomes stable and the time at which the fixing temperature reaches the predetermined temperature as described above. Accordingly, when the fixing temperature reaches the predetermined temperature, all the conditions required to start the operations are met. Thus, the subsequent processes can be performed under the stable state. Therefore, it is not necessary to wait until the detection output from the concentration detecting sensor 44 becomes stable when the fixing temperature has already reached the predetermined temperature, and consequently, delay will not occur.

A start of the drive of the fuser roller 25 may be controlled at timing when the fixing temperature reaches the predetermined temperature. Thus, the operation control may be performed in accordance with characteristic features of the fixing temperature.

Figure 4:
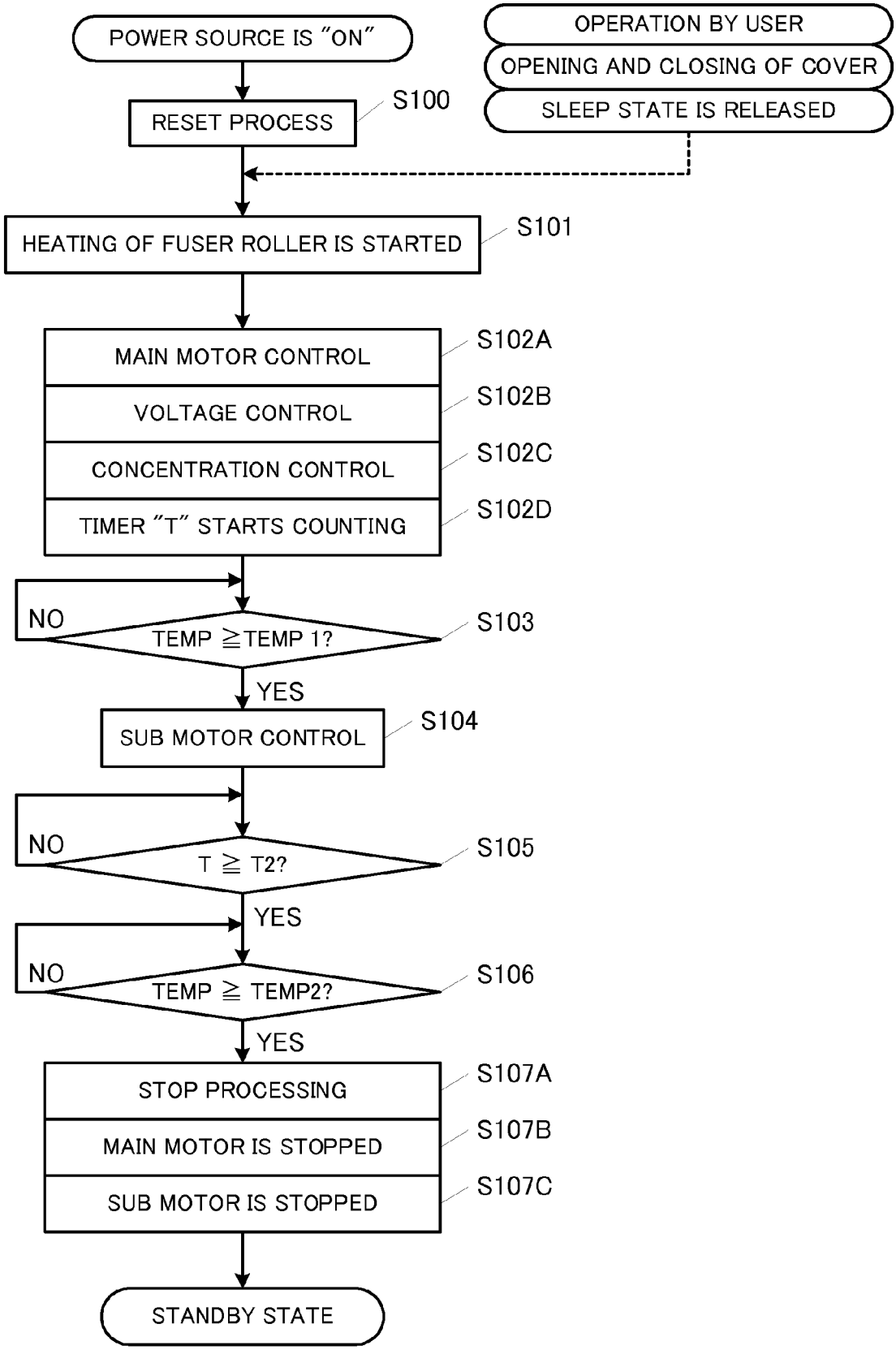
FIG. 4 is a process flow chart illustrating a warm-up operation.
Figure 5:
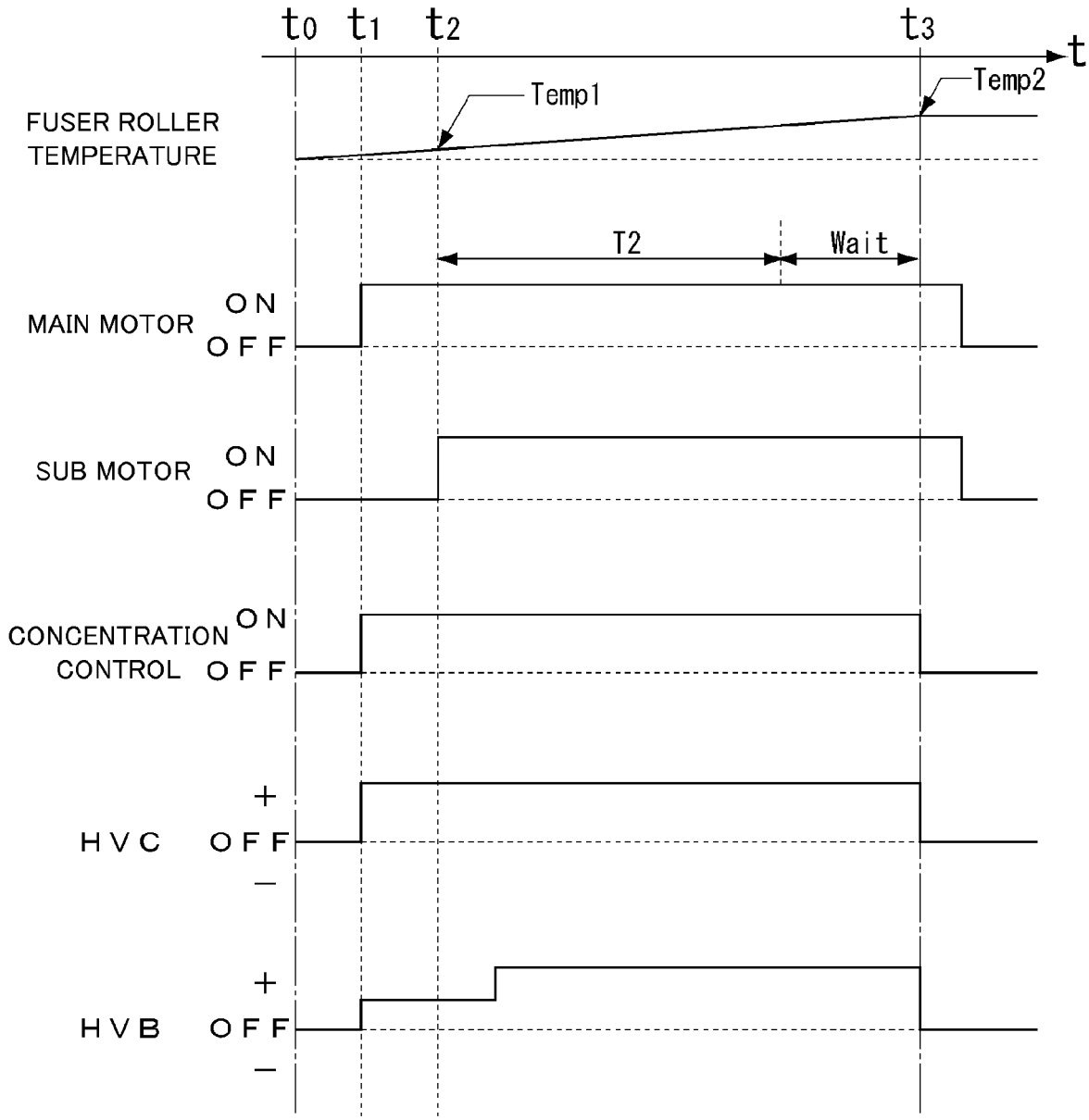
FIG. 5 is a time chart illustrating a warm-up operation.

FIG. 4 is a process flow chart illustrating a warm-up operation performed from a time at which a power source of the device is turned on to a time at which the device goes into a standby state. FIG. 5 is a time chart illustrating a warm-up operation.

Immediately after the power source of the device is turned on at time "t0", a reset process is performed (S100), and initial setting of the image forming device 1 is performed. After the reset process, the control device 100 starts heating control of the fuser roller 25 (S101). Then, the control device 100 controls to raise a fuser roller temperature "Temp" to a temperature "Temp2" at which the warm-up process is completed.

After the heating of the fuser roller 25 is started, a pre-rotation process is performed from time "t1" (S102). In consideration of the time needed for the detection output from the concentration detecting sensor 44 to be stable, start timing of the pre-rotation process is preferably set such that the detection output becomes stable before the temperature "Temp" reaches the temperature "Temp2".

In the pre-rotation process, the rotation of the main motor 60 is started (S102A). By the rotation of the main motor 60, the photoconductive drum 22, the developing roller 40, and the transfer roller 23 etc. are rotated. Then, charge of a charging voltage HVC and a developing voltage HVB etc. is controlled (S102B). Accompanying the start of the rotation of the main motor 60, the toner supply control by the transportation spirals etc. of the toner supplying mechanism 50 and the developer transportation control by the augers etc. of the developing unit 19 are started, and the concentration control based on the detection output from the concentration detecting sensor 44 is performed (S102C). Then, a timer "T" starts counting when the rotation of the main motor 60 is started (S102D).

Next, the control device 100 checks whether or not the temperature "Temp" has risen to a temperature "Temp1" (S103). When the fuser roller temperature "Temp" reaches the temperature "Temp1" at time "t2", the rotation of the sub motor 62 is started at the time "t2" (S104), and preliminary rotation of the fuser roller 25 is started.

The control device 100 checks whether or not the timer "T" has counted a time period "T2" (S105). When the time period "T2" elapses, it is checked whether or not the fuser roller temperature "Temp" has risen to the temperature "Temp2" (S106). When it is determined that the temperature "Temp" reached the temperature "Temp2" at time "t3", stop processing of the pre-rotation process is performed (S107). Specifically, stop processing of voltage control etc. for preventing the carrier from scattering is performed (S107A), the main motor 60 is stopped (S107B), the sub motor is stopped (S107C), and the state is shifted to the standby state.

Figure 6:
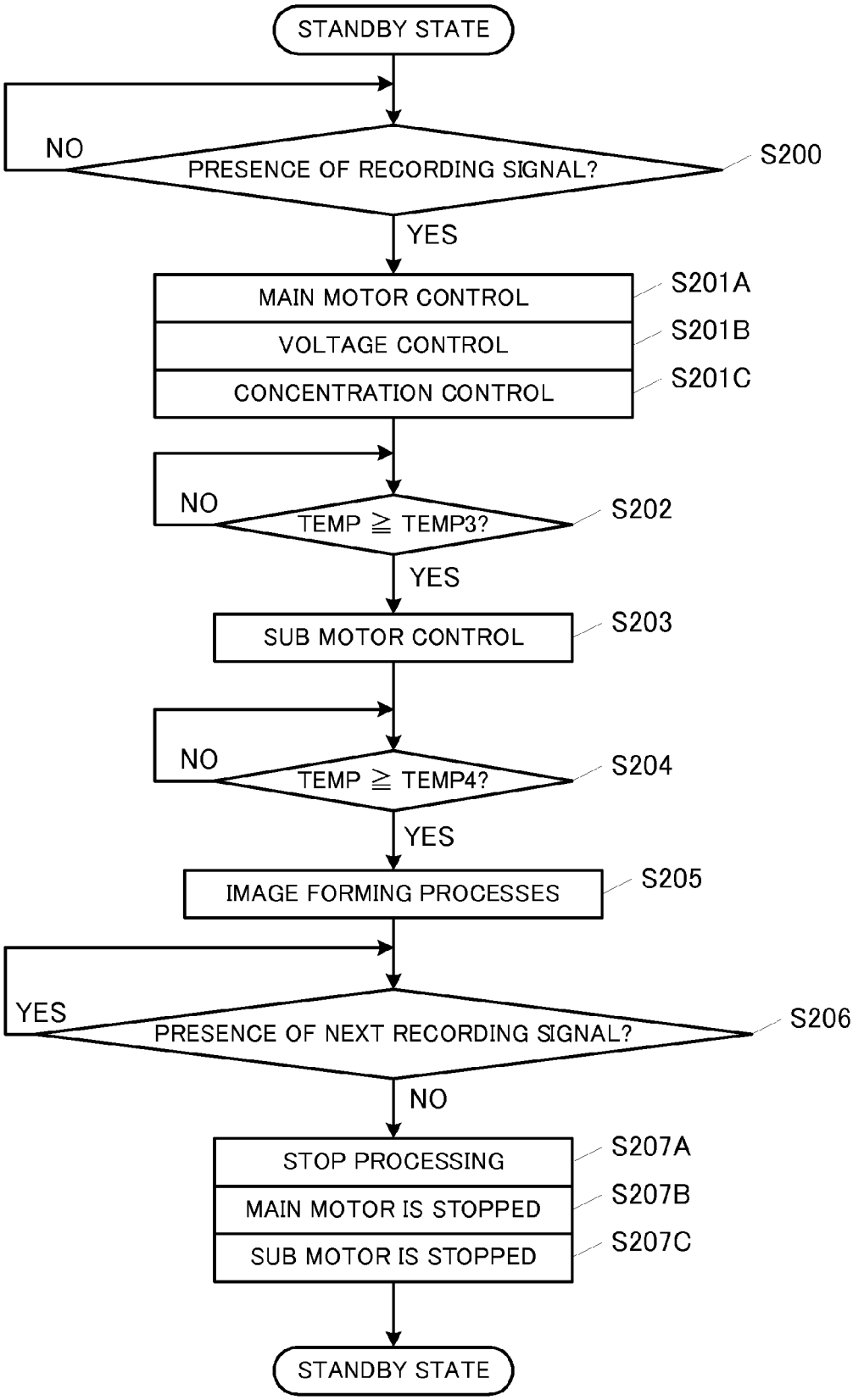
FIG. 6 is a process flow chart illustrating an image forming operation.
Figure 7:
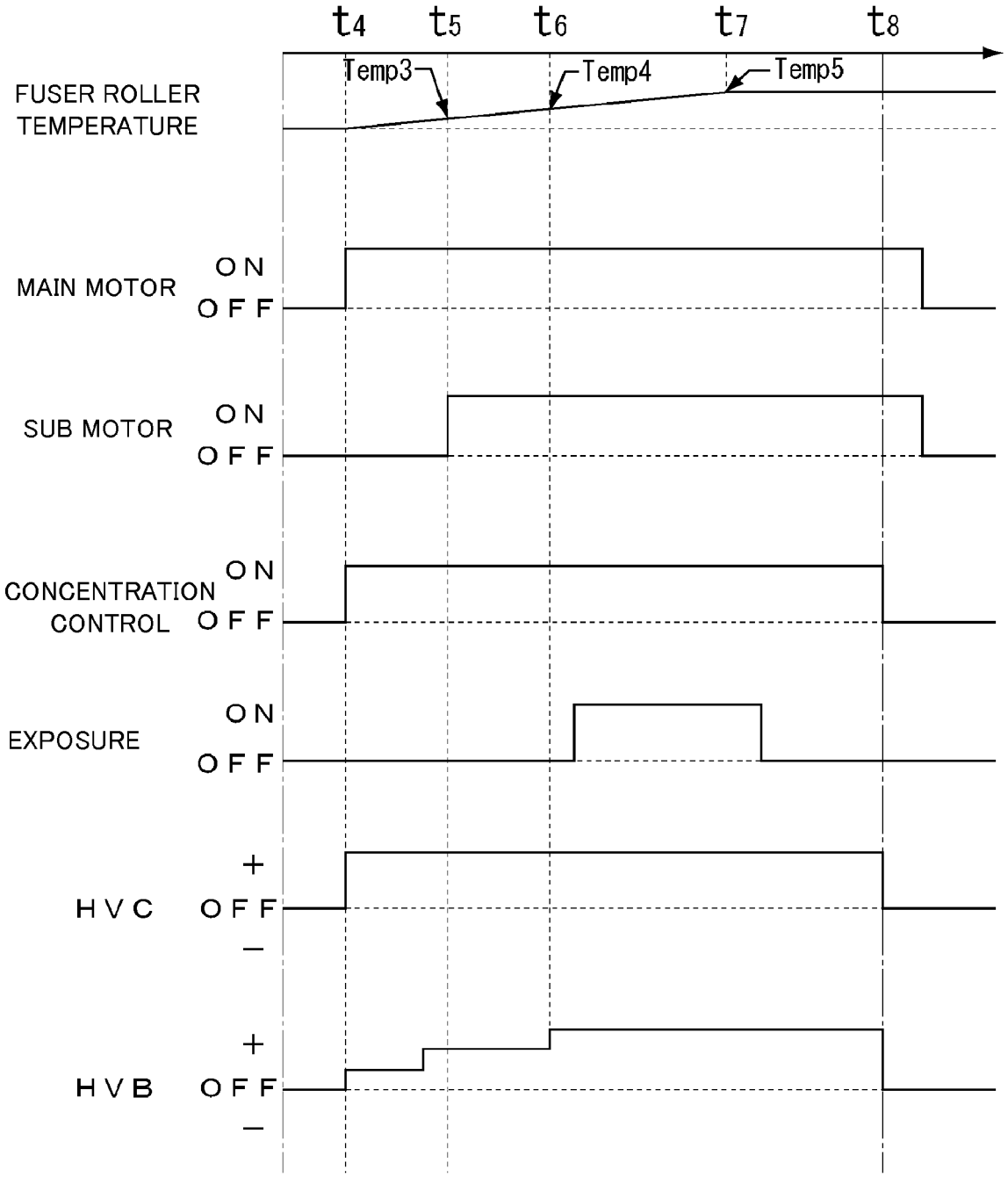
FIG. 7 is a time chart illustrating an image forming operation.

FIG. 6 is a process flow chart illustrating a case in which the recording signal is input under the standby state. FIG. 7 is a time chart of the process flow illustrated in FIG. 6.

The control device 100 checks whether or not the recording signal was input at time "t4" (S200). When the recording signal is input, the control device 100 re-starts the heating control of the fuser roller 25 and controls to raise the temperature "Temp" to a temperature "Temp5".

Then, the pre-rotation process is started (S201), and the rotation of the main motor 60 is started (S201A). By the rotation of the main motor 60, the photoconductive drum 22, the developing roller 40, and the transfer roller 23 etc. are rotated. In addition, the voltage control of the charging voltage VHC, and the developing voltage HVB etc. is performed (S201B). As the rotation of the main motor 60 is started, the toner supply operation by the transportation spirals etc. of the toner supplying mechanism 50 and the developer transportation control of the augers etc. of the developing unit 19 are started. Moreover, the concentration control based on the detection output from the concentration detecting sensor 44 is performed (S201C).

Next, the control device 100 checks whether or not the temperature "Temp" has risen to a temperature "Temp3" (S202). When the control device 100 determines that the fuser roller temperature reached the temperature "Temp3" at time "t5", the rotation of the sub motor 62 is started at the time "t5" (S203), and the preliminary rotation of the fuser roller 25 is started. Then, the control device 100 checks whether or not the temperature "Temp" has reached a temperature "Temp4" that is necessary for a fixing operation (S204). When the control device 100 determines that the fuser roller temperature reached the temperature "Temp4" at time "t6", the image forming processes are started at the time "t6". In other words, along with exposure control, the paper transporting operation is performed. When the image forming processes for the first paper are completed, the control device 100 checks whether or not a next recording signal has been input (S206). Then, when the next recording signal has been input, the image forming processes are performed again.

When the next recording signal has not been input, the stop processing of the voltage control etc. for preventing the carrier from scattering is performed (S207A), the main motor 60 is stopped (S207B), the sub motor 62 is stopped (S207C), and the state is shifted to the standby state.

As described above, upon the warm-up operation and the image forming operation, when starting the drive of the main motor and the sub motor, the drive of the main motor is started before the drive of the sub motor, and the concentration control is performed. The drive of the sub motor is started when the fixing temperature reaches the predetermined temperature. Therefore, it can be possible to obtain time for the detection output from the concentration detecting sensor in the supply control to become stable. Accordingly, when the operations of each device are controlled based on the fixing temperature, it can be possible to reach a state in which the detection output from the concentration detecting sensor is stabilized before the fixing temperature reaches the predetermined temperature.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. An image forming device comprising:

an image carrier arranged to form an electrostatic latent image on a surface thereof;

a developing device arranged to store two-component developer including toner and carrier and visualize the electrostatic latent image formed on the image carrier into a toner image;

a transfer device arranged to transfer the toner image formed on the image carrier onto a paper;

a fuser device arranged to fix the transferred toner image onto the paper;

a control device arranged to control rotation of the image carrier and control each of the devices to form an image on the paper;

a first driving device arranged to drive the devices other than the fuser device;

a second driving device arranged to drive the fuser device separately from the other devices; and a concentration detecting device arranged to detect toner concentration of the two-component developer transported in the developing device, wherein the control device executes toner concentration control to control an operation of the developing device such that a value of detection output detected by the concentration detecting device falls within a predetermined range, and when controlling drive of the first driving device and the second driving device, the control device executes operation control that starts the drive of the first driving device before the drive of the second driving device.

2. The image forming device according to claim 1, wherein when executing the operation control, the control device starts the drive of the second driving device when a fixing temperature of the fuser device exceeds a predetermined temperature.

3. The image forming device according to claim 2, further comprising a toner supplying mechanism arranged to supply the toner to the developing device, wherein when executing the toner concentration control, the control device controls a toner supplying operation performed for the developing device by the toner supplying mechanism.

4. The image forming device according to claim 3, further comprising a developer circulating and transporting mechanism that circulates and transports the developer inside the developing device, wherein when executing the toner concentration control, the control device controls the developer circulation and transportation in the developing device performed by the developer circulating and transporting mechanism.

5. The image forming device according to claim 4, wherein the concentration detecting device detects the toner concentration of the developer that is circulated and transported by the developer circulating and transporting mechanism in the developing device.

6. The image forming device according to claim 5, wherein the concentration detecting device detects the toner concentration by measuring permeability of the developer.

7. The image forming device according to claim 4, wherein the developer circulating and transporting mechanism includes a pair of augers that transport the developer in mutually opposite directions.

8. The image forming device according to claim 3, further comprising a toner cartridge that contains the toner, wherein the toner supplying mechanism supplies the toner from the toner cartridge to the developing device.

9. The image forming device according to claim 2, wherein upon a warm-up operation that is performed from when a power supply of the image forming device is turned on until a state goes into a standby state, the control device executes the toner concentration control and the operation control.

10. The image forming device according to claim 2, wherein the control device executes the toner concentration control and the operation control after a recording signal has been input to the image forming device.

11. The image forming device according to claim 2, wherein the control device adjusts drive-start timing of the second driving device in order that a time at which the detection output from the concentration detecting device becomes stable is synchronized with a time at which the temperature of the fuser device reaches the predetermined temperature.

12. The image forming device according to claim 2, wherein the fuser device includes a fuser roller for heating the toner on the paper.

* * * * *